US005372497A

United States Patent [19]

Coolidge et al.

[11] Patent Number: 5,372,497

[45] Date of Patent: Dec. 13, 1994

[54] PROCESS AND APPARATUS FOR IGNITING A BURNER IN AN INERT ATMOSPHERE

[75] Inventors: Dennis W. Coolidge, Katy, Tex.; Franklin G. Rinker, Perrysburg, Ohio

[73] Assignee: SGI International, La Jolla, Calif.

[21] Appl. No.: 66,345

[22] Filed: May 24, 1993

[51] Int. Cl.[5] ..... F23N 5/20

[52] U.S. Cl. ..... 431/6; 431/31; 431/48; 431/60; 431/283

[58] Field of Search ..... 431/6, 30, 31, 49, 48, 431/46, 60, 175, 283

[56] References Cited

U.S. PATENT DOCUMENTS

| | | | |
|---|---|---|---|
| 2,755,852 | 7/1956 | Andrews et al. | 431/46 |
| 2,986,207 | 5/1961 | Scogin | 431/283 |
| 3,086,583 | 4/1963 | Reichow | 431/46 |
| 3,677,533 | 7/1972 | Oliver et al. | 263/52 |
| 3,759,795 | 9/1973 | Oliver et al. | 201/25 |
| 4,089,628 | 5/1978 | Blackburn | 431/6 |
| 4,395,309 | 7/1983 | Esztergar | 201/22 |
| 4,521,278 | 6/1985 | Kelley et al. | 201/17 |
| 4,548,577 | 10/1985 | McGill | 431/202 |
| 4,634,369 | 1/1987 | McGill et al. | 431/3 |
| 4,924,785 | 5/1990 | Schultz et al. | 110/346 |

OTHER PUBLICATIONS

Forging Coal's New Future, SGI International, 6 pages, no date.

SGI International 1991 Annual Report, Mar. 17, 1992, 20 pages.

A Good Planet is Hard to Find, SGI International, 8 pages, no date.

*Primary Examiner*—Carroll B. Dority

*Attorney, Agent, or Firm*—Willian Brinks Hofer Gilson & Lione

[57] ABSTRACT

According to this invention there is provided a process and apparatus for the ignition of a pilot burner in an inert atmosphere without substantially contaminating the inert atmosphere. The process includes the steps of providing a controlled amount of combustion air for a predetermined interval of time to the combustor then substantially simultaneously providing a controlled mixture of fuel and air to the pilot burner and to a flame generator. The controlled mixture of fuel and air to the flame generator is then periodically energized to produce a secondary flame. With the secondary flame the controlled mixture of fuel and air to the pilot burner and the combustion air is ignited to produce a pilot burner flame. The pilot burner flame is then used to ignited a mixture of main fuel and combustion air to produce a main burner flame. The main burner flame then is used to ignite a mixture of process derived fuel and combustion air to produce products of combustion for use as an inert gas in a heat treatment process.

28 Claims, 7 Drawing Sheets

PROCESS AND APPARATUS FOR IGNITING A BURNER IN AN INERT ATMOSPHERE

FIELD OF THE INVENTION

This invention relates to a process and apparatus for igniting a burner in an inert atmosphere. More particularly, this invention relates to a process and apparatus for igniting a burner in an inert atmosphere for producing an oxygen deficient gas stream used in the heat treatment of gas permeable, solid carbonaceous materials.

BACKGROUND OF THE INVENTION

This invention is concerned with the ignition of fuel and air mixtures within an inert atmosphere. As used herein the term "inert atmosphere" refers to an atmosphere unsuitable to support combustion, e.g. containing no more than 10% oxygen. It will be appreciated, for safety reasons, it is preferred that the inert atmosphere in accordance with the present invention contain no more than 5% oxygen and such other components as desired, e.g., $N_2$, $CO_2$, water vapor and hydrocarbons.

It is known that various closed gaseous systems operate with significant concentrations of unburned hydrocarbons in an inert high temperature gaseous atmosphere used for the processing of combustible materials. During start-up and perhaps, more significantly, during restart of a burner it is necessary to provide a means to effect the ignition of the burner without substantially altering the inert nature of the atmosphere during this transitory condition. As used herein the term "closed" refers to a system that is isolated from ambient conditions.

For example, one closed system is disclosed in U.S. patent application Ser. No. 08/029556, filed Mar. 11, 1993 and contains unburned hydrocarbons and is useful for increasing the thermal energy released during drying and gasification of coal by utilizing large volumes of continuously flowing streams of inert gas for convective heat transfer. Inert gas as used herein refers to a gas having generally less than 5% oxygen by weight.

Heretofore, inert gas streams have typically been produced using well known air separation technologies such as cryogenic distillation, membrane separation and pressure swing absorption. Although the known methods of producing inert gas streams for coal drying and mild gasification processes have been proven to perform satisfactorily in certain applications, these technologies are cost ineffective when considered for large processing needs like mild coal gasification, coke preheating and the like. Large mild coal gasification systems may range up to 8,000 square feet and may use 5,000 to 10,000 standard cubic feet of inert gas per hour per square foot of cross section for thermal treatment of coal and/or oil shale whether the coal and/or oil shale is to be dried or fractioned into solid and gaseous phase components.

A preferred method for recycling of an oxygen deficient gas stream used in the heat treatment of combustible materials includes a coal drying process and a mild coal gasification process employing, in combination, recycling of inert gas and renewal of both the inert gas components and the sensible energy. The preferred method requires precise control of inert gas chemistry, gas supply temperature and advanced flammable gas and vapor handling technology. As used herein, recycled inert gas means that the inert gas, i.e., nitrogen from air, carbon dioxide from combustion and water vapor from combustion or from the drying process are recycled within the system except for controlled venting. Similarly, as used herein, renewal of both the inert gas components and the sensible energy means that a portion of the recirculated gas stream is mixed with air in a combustion chamber to release heat and to oxidize a portion of combustible vapors and gases which result from the thermal process, and as may be picked up in the recycle process. The recycling and renewal of the inert gas and utilization of process derived low calorific inert gas facilitates the possibility of an economically feasible advanced heat treatment process for combustible materials such as gas permeable, solid carbonaceous materials.

It will be appreciated that it is difficult to ignite a pilot and/or a burner in an inert atmosphere so as not to contaminate the inert composition of the recirculated gases in either the coal drying process or mild coal gasification process. Furthermore, the presence of volatile combustible materials necessitates that the inert atmosphere within the system be maintained, especially during ignition or reignition to prevent the inadvertent combustion of the combustible materials.

Accordingly, one aspect of the present invention is to provide a method of igniting a flame in an inert atmosphere without substantially changing the inert nature of the gaseous atmosphere within the system or permitting significant entry of oxygen for unintentional ignition of the hydrocarbons contained in the system. The present invention is particularly applicable for igniting both a pilot flame and a main burner flame useful in the production of large continuously flowing volumes of inert gas as may be required for bulk drying and mild gasification of substantially continuously flowing streams of coal or other carbonaceous free flowing bulk solids. The on-gas streams are recycled meaning that the inerts, (i.e., nitrogen from air, carbon dioxide from the combustion reaction and water vapor from either the combustion reaction or from drying) remain except for venting, and are utilized repetitively.

SUMMARY OF THE INVENTION

Briefly, according to this invention there is provided a process for igniting a burner of a combustor to produce a burner flame within a closed system containing an inert atmosphere without substantially contaminating the inert atmosphere. The process includes the steps of purging the combustor to establish an inert atmosphere within the combustor and supplying a controlled amount of combustion air for a predetermined interval of time to the combustor. A controlled mixture of fuel and air is then substantially simultaneously supplied to a pilot burner and to a flame generator. The controlled mixture of fuel and air to the flame generator is periodically energized to produce a secondary flame. The secondary flame then ignites the controlled mixture of fuel and air to the pilot burner and the combustion air to produce a pilot burner flame. After ignition of the pilot burner flame a controlled amount of fuel and air is supplied to the main burner within the combustor which is then ignited with the pilot burner flame to produce a main burner flame. After the main burner flame is ignited a controlled amount of process derived fuel and air is supplied to the primary burner within the combustor and ignited with the main burner flame to produce a primary burner flame.

The process of the present invention is achieved by a pilot burner apparatus including a second valve means for selectively introducing a controlled amount of combustion air to the combustor, a third valve means for selectively unblocking pilot fuel and pilot air to a pilot burner and a fourth valve means for selectively unblocking flame generator fuel and flame generator air to a secondary flame generator including an energizer and a firing tube. The energizer, positioned external of the combustor, intermittently energizes the flame generator fuel and flame generator air to produce a secondary flame internal of the combustor within the firing tube to ignite the controlled mixture of pilot fuel, pilot air and combustion air to produce a primary pilot flame internal of the combustor. Subsequently, the primary pilot flame may ignite a mix of main fuel from a first valve means and combustion air to produce a main burner flame for combustion of a process derived fuel and primary air within the combustor and generation of products of combustion for use as an inert gas.

Unless otherwise indicated, as used herein the term "fuel" refers to any material that is burnt to release thermal energy whether the "fuel" is a process derived fuel, or an externally supplied fuel, (e.g., methane), or a combination of the two. Furthermore, as used herein, the term "combustibles" refers to hydrocarbon molecules and other materials which can combust in the presence of oxygen and heat.

BRIEF DESCRIPTION OF THE DRAWINGS

Further features and other aspects and advantages of this invention will become clear from the following detailed description made with reference to the drawings in which.

DESCRIPTION OF THE PREFERRED EMBODIMENTS

Figure 1:
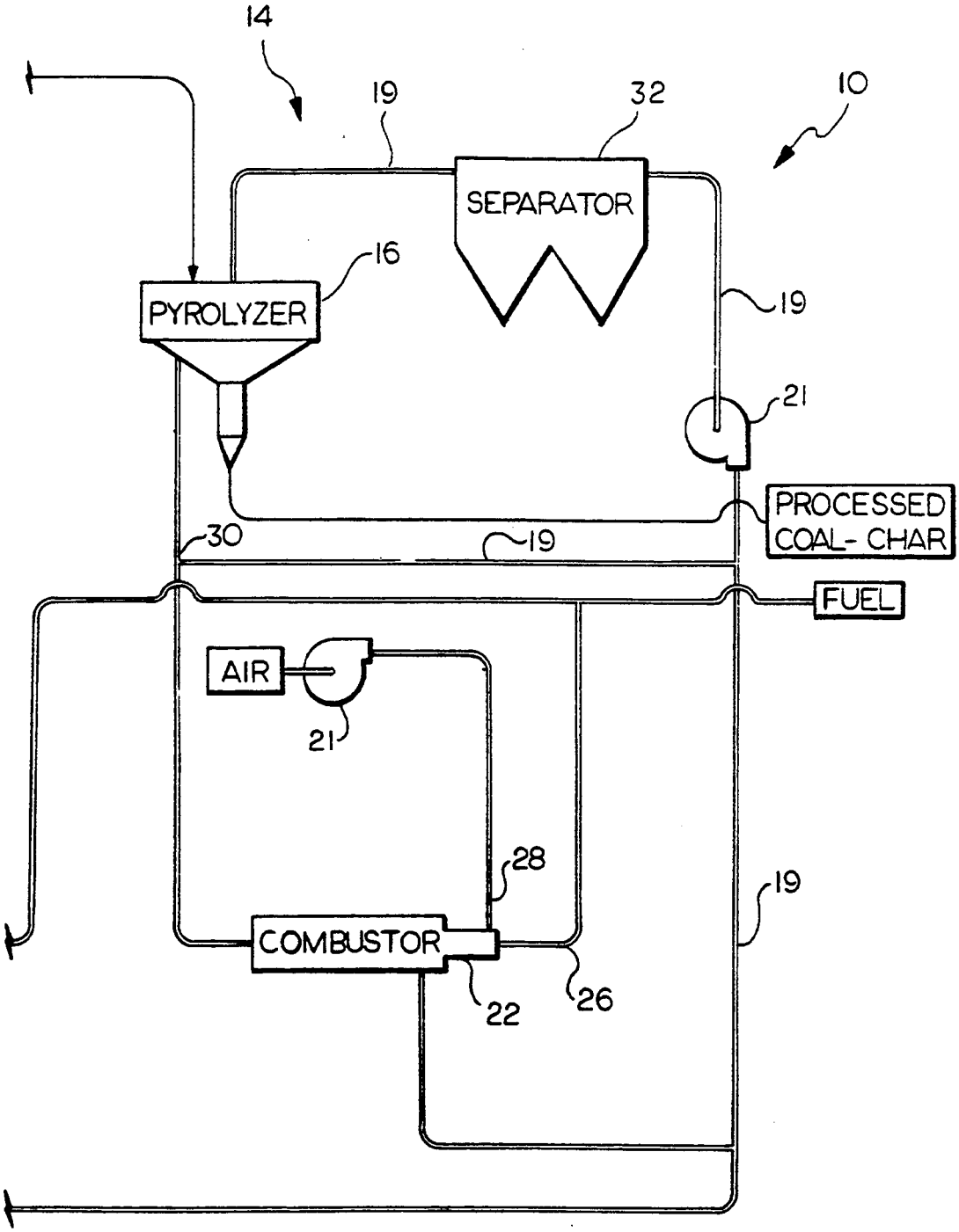
FIG. 1 is a diagrammatic presentation of a pyrolysis circuit for heat treating combustible materials.
Figure 2:
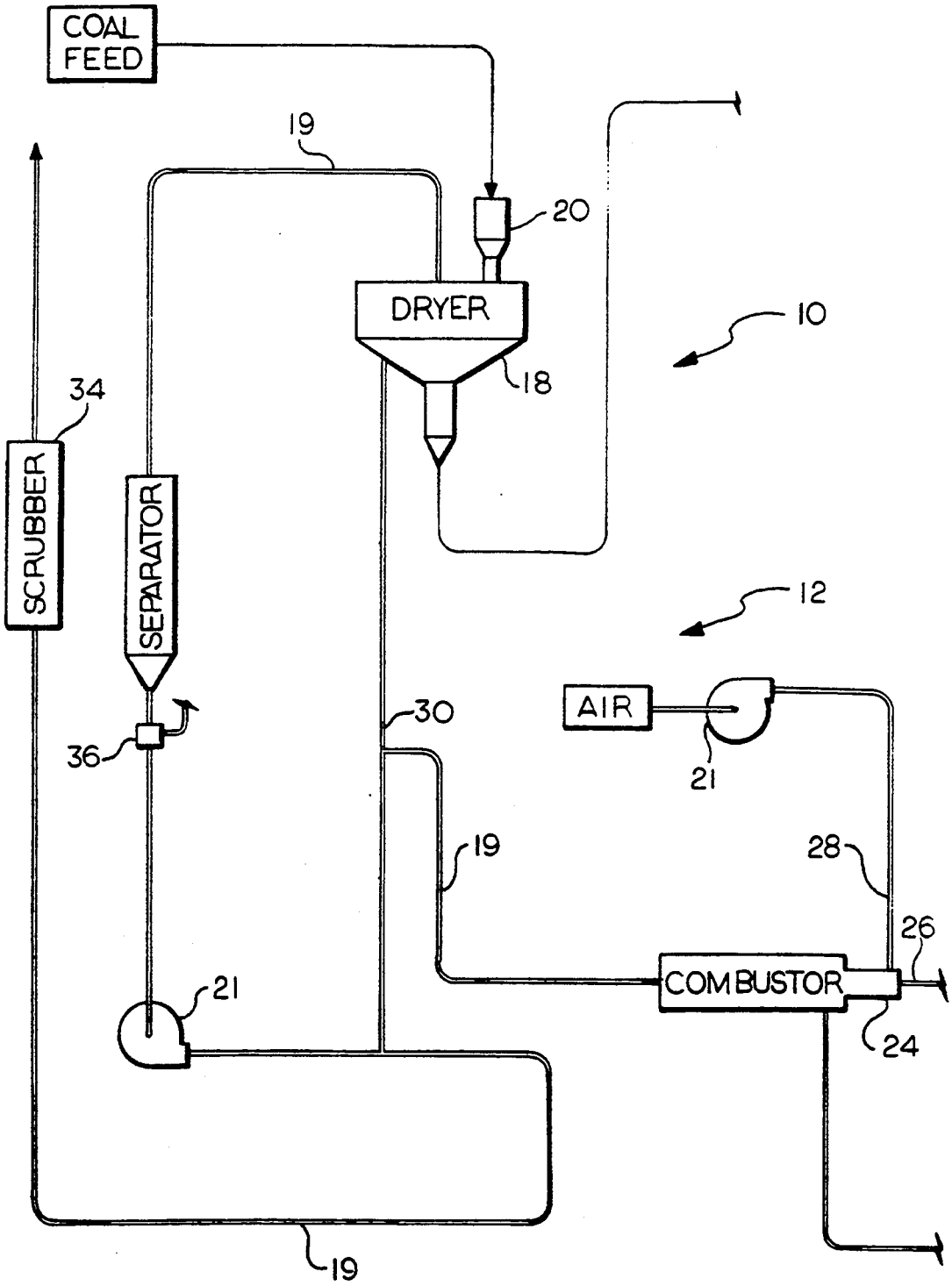
FIG. 2 is a diagrammatic presentation of a dryer circuit for heat treating combustible materials.

Referring to the drawings, wherein like reference characters represent like elements, FIGS. 1 and 2 depict a system 10 for recycling of an oxygen deficient gas stream used in the heat treatment of combustible materials such as gas permeable, solid carbonaceous materials. The system 10 comprises, in combination, a drying process 12 and a mild gasification process 14 for heat treatment of combustible materials utilizing a recycled oxygen deficient gas stream. Although the present invention will be described in connection with the ignition of a burner used for generating an oxygen deficient gas stream used in the heat treatment of combustible materials it will be appreciated that the present invention may find application in the ignition of most any burner in an inert atmosphere where the inert nature of the atmosphere is to be maintained.

In considering FIGS. 1–6, it will be appreciated that for purposes of clarity some of the details of construction have not been provided in view of such details being conventional and well within the skill of the art once the invention is disclosed and explained. Reference is made to COMBUSTION TECHNOLOGY MANUAL, 4th Edition, Industrial Heating Equipment Association, Virginia, 1988, Perry and Chilton, CHEMICAL ENGINEERS' HANDBOOK, 5th Edition, McGraw Hill, New York, 1973, and to the chemical processing industry literature generally for detailed descriptions on the various apparatus and processing structures and conditions. For example, a combustor 22 and 24, pyrolyzer 16, a dryer 18, piping 19, blowers 21 and valves may be any such known commercially available components with the exception that such components may be modified as necessary by one skilled in the art to be employed in the overall system 10 of the present invention as discussed herein. In addition, many control devices which are conventional and standard in chemical processing have been omitted for clarity of illustrating and describing the invention. For example, control valves, thermocouples, thermistors, coupled with suitable servo circuits are readily available and conventionally used for measuring and controlling temperature and process flow.

Referring to FIGS. 1 and 2, the system 10 is particularly suited for combustible materials such as gas permeable solid carbonaceous materials containing a high moisture content such as Western lignite coal. The coal material may be conveyed through the system 10 along a conventional continuous conveyor belt (not shown), by a vibratory conveyor, pneumatically or in any other suitable manner. For efficiency, the coal may be prepared by washing, crushing and classifying to provide coal of suitable quality, quantity and particle size.

The process of the system 10 generally includes conveying the coal to a coal dryer feed hopper 20 and dryer 18. The dryer 18 heats the coal to reduce the moisture content of the coal. The temperature of the coal is controlled below approximately 600 degrees fahrenheit so that no significant amounts of methane and/or carbon monoxide are released from the coal. The dry coal is then conveyed to a pyrolyzer 16 where the rate of heating of the solids and residence time are controlled to achieve certain desired properties of the coal, e.g., lower relative sulphur content and higher relative carbon content. During processing of the coal in the pyrolyzer 16, all remaining free moisture is removed and a chemical reaction occurs resulting in the release of volatile gaseous material and the formation of char. The processed coal or char is then removed from the pyrolyzer, quenched, cooled and transferred for storage and/or conveyed for combustion in combustors as required as a process derived fuel.

As previously described, the pyrolyzer 16 and dryer 18 may be any suitable bulk solid heat transfer device including either a rotary grate, horizontal grate, sliding grate or fluidized bed for convective heat transfer. The pyrolyzer 16 may be of any type known in the art such as a batch type pyrolyzing furnace or a continuous type pyrolyzing furnace. Batch type pyrolyzing furnaces are essentially Box type furnaces and are distinguished by the types of drive mechanisms used to transfer the coal to be pyrolyzed into and out of the furnace. In so far as continuous type pyrolyzing furnaces are concerned, there are essentially three types of furnaces. One of the most common is a rotary kiln pyrolyzer which includes a horizontal rotating cylinder with the coal material to be heated tumbled on the inside. A helical auger is typically installed on the kiln's inside diameter thereby providing a means for transporting the coal material through the furnace. Another type of continuous pyrolyzer includes a vertical shaft and sliding bed furnace where coal is fed at the top of a cylindrical shaft and the coal is discharged at the bottom. Various bustle and tuyere arrangements are employed to treat the descending load through the furnace as a continuous fluidized bed. A third type of continuous pyrolyzer is a rotary hearth. A rotary hearth has an annular shaped hearth rotating in a stationary furnace chamber and coal is continually fed into a cold zone. A stationary spreader distributes the coal uniformly in a radial direction as the hearth rotates under the spreader. For a more detailed discussion of furnaces useful in pyrolysis, reference is made to U.S. Pat. No. 4,924,785, incorporated herein by reference.

The inert gas utilized for drying and pyrolysis of the coal material is produced by a first combustor 22 and a second combustor 24. The combustors 22 and 24 are of similar construction and therefore only one combustor will be described in detail.

Figure 3:
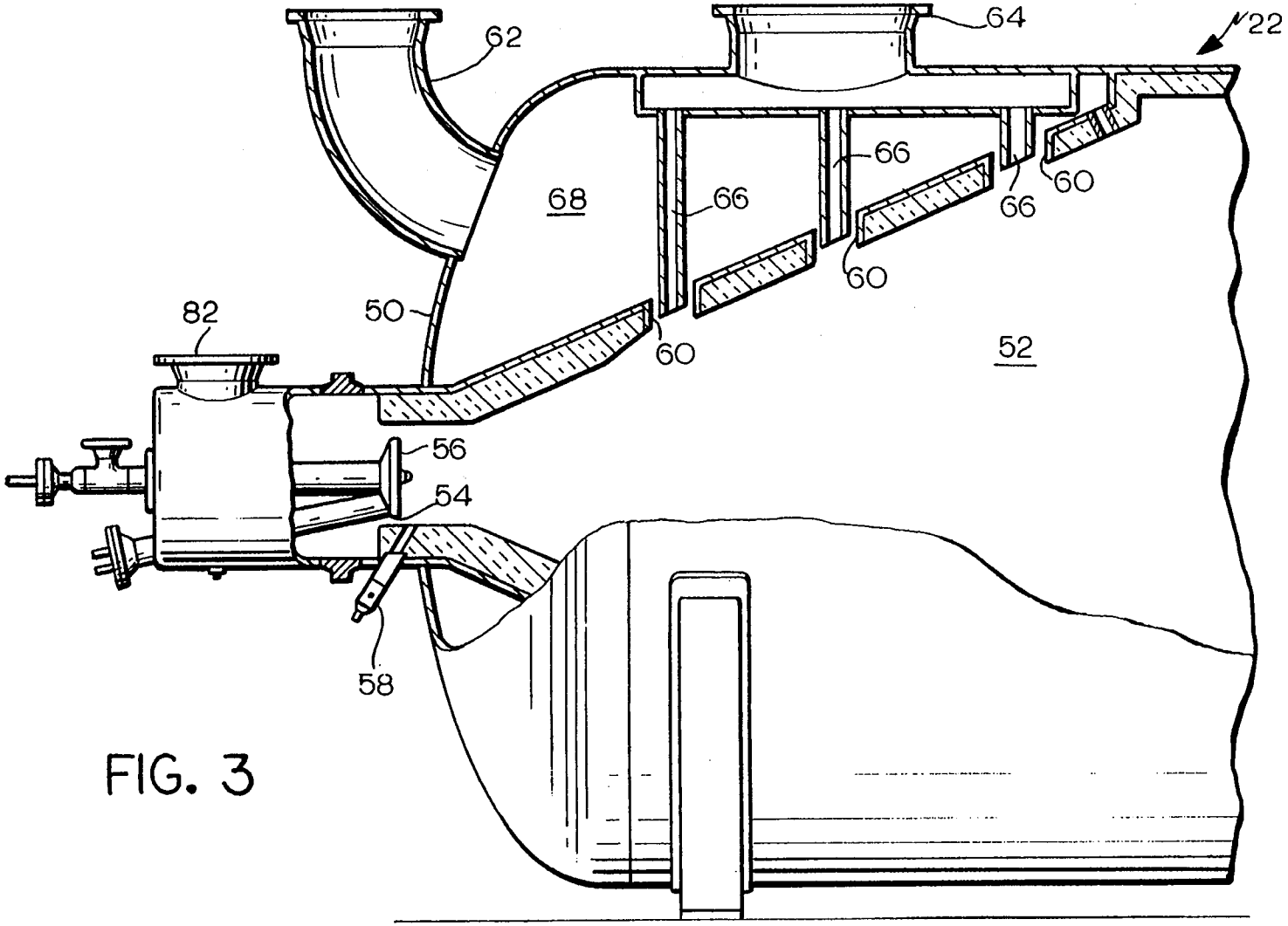
FIG. 3 is a partial cross-sectional side view of a combustor shown in FIGS. 1 and 2 including a pilot system in accordance with the present invention.
Figure 4:
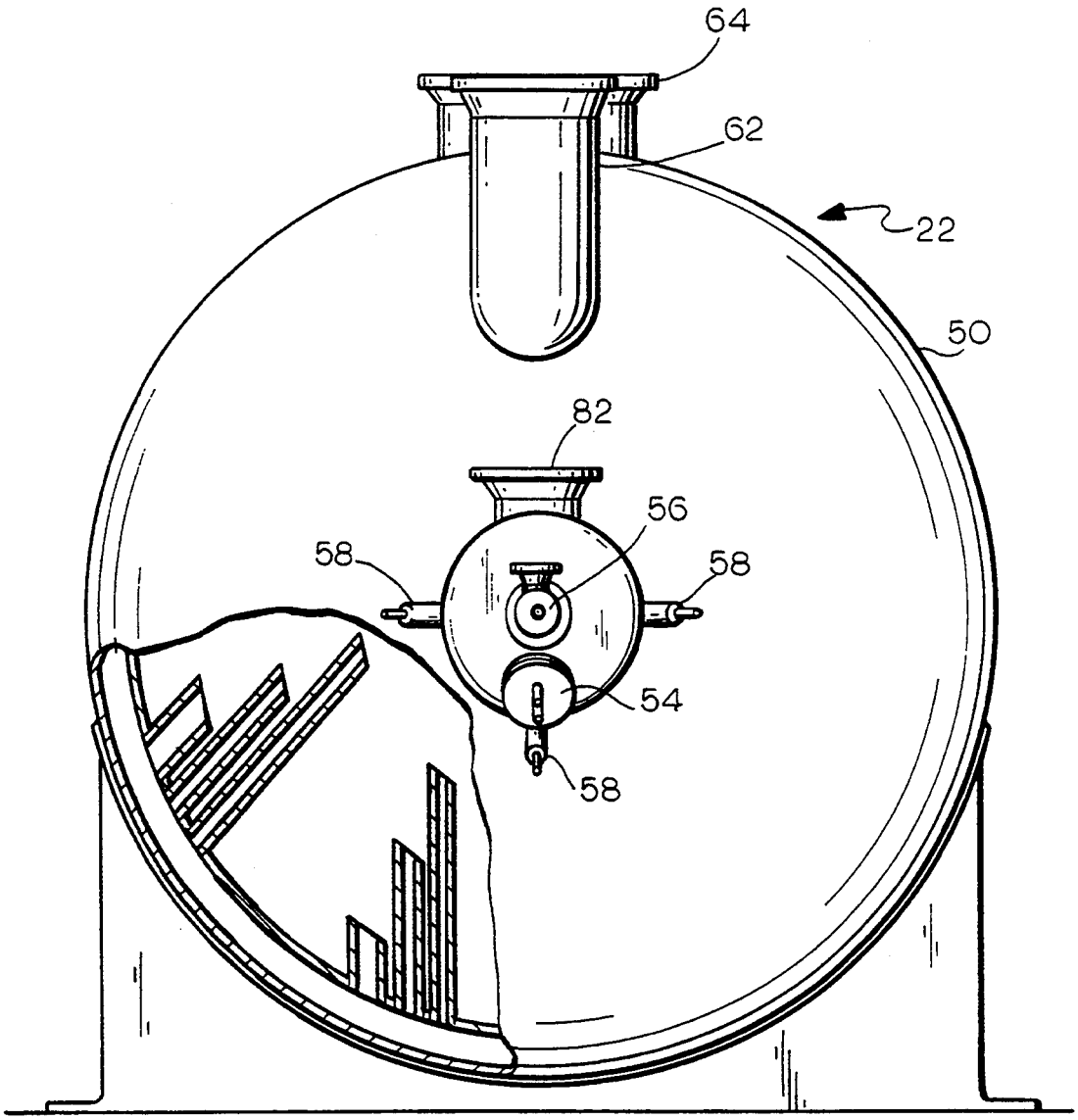
FIG. 4 is an end view of the combustor of FIG. 3.

As shown in FIGS. 3 and 4, the combustor 22 or 24 is generally of a cylindrical shape having outer walls 50 made of most any suitable material to withstand high temperature and the forces of combustion. The combustor 22 or 24 includes an inner chamber 52 having a frustoconical shape formed of a suitable refractory material and a forward end housing containing a pilot burner assembly 54 and main burner assembly 56. Flame sensor ports containing flame sensors 58 are positioned about the periphery of the housing to detect combustion. The flame sensors 58 are of a design well known in the art such as ultraviolet (UV) radiation sensors and the like.

Formed about the periphery of the inner chamber 52 are a plurality of spaced openings 60. Primary air and primary fuel, as further described herein, are introduced to the combustor 22 or 24 through primary air inlet 62 and primary fuel inlet 64. The primary fuel passes through the primary fuel inlet 64 and through a bank of tubes 66 (for example, 3 rows of 8 tubes) spaced about the periphery of the combustor. The tubes 66 are of varying diameter and length for dispersing the primary fuel within the inner chamber 52. The primary air is introduced through primary air inlet 62 into a chamber 68 formed between the frustoconical inner chamber 52 and walls 50 of the combustor. The primary air flows through openings 60 and intermixes with the primary fuel within the inner chamber 52. Combustors suitable for use in the present invention may be obtained from John Zink, Tulsa, Okla. and Peabody Engineering, Stamford, Conn.

Figure 5:
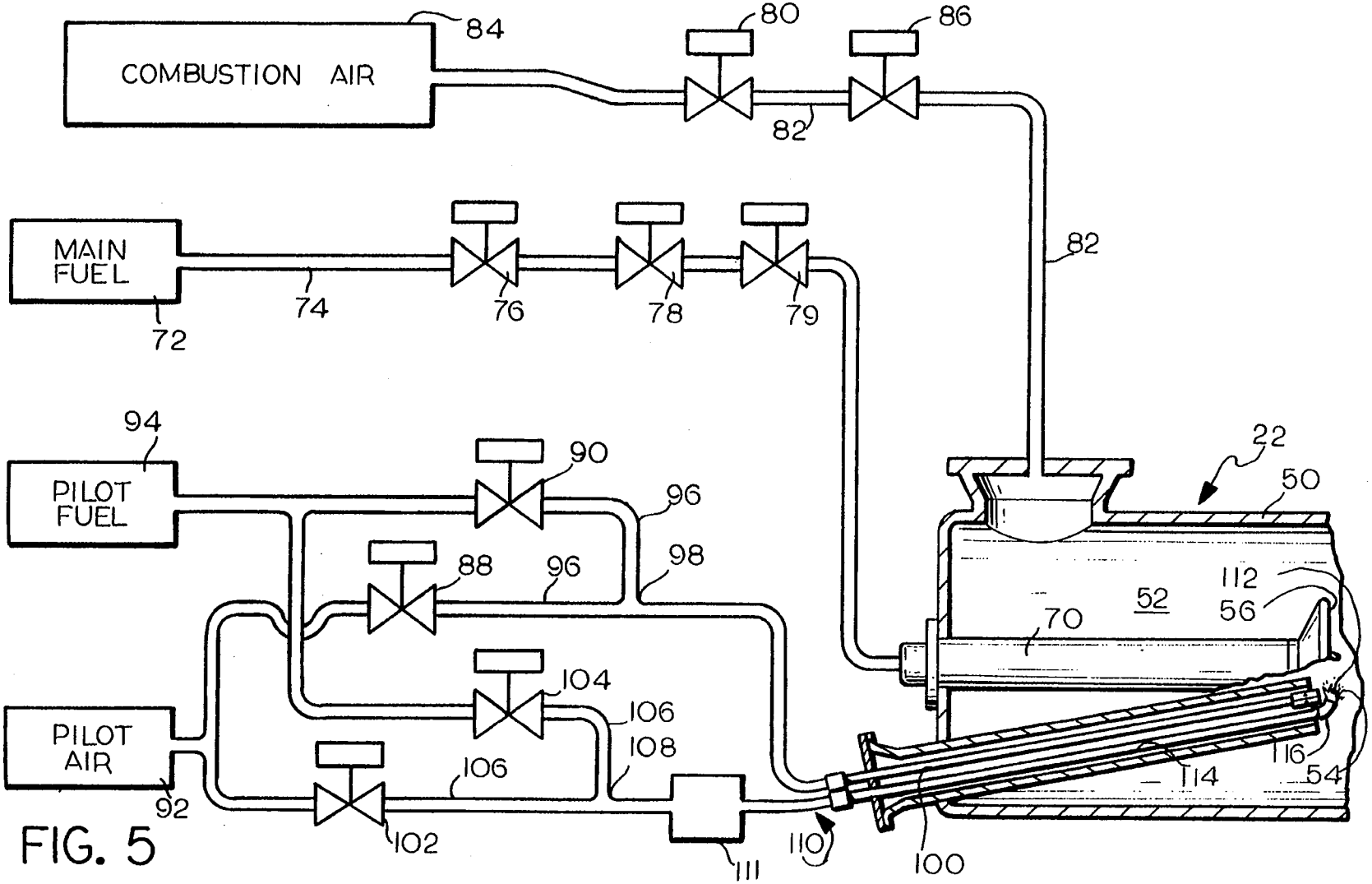
FIG. 5 is a diagrammatic representation of a burner system for the combustors of FIGS. 4 and 5.

The pilot burner assembly 54 is of the direct burner type wherein the fuel and oxidizer are mixed at the point of ignition. As shown in FIGS. 3–5, the pilot burner assembly 54 in accordance with the present invention includes a second valve means for selectively introducing a controlled amount of combustion air to the combustor 22 or 24. As shown in FIG. 5, the second valve means includes a first combustion air blocking valve 80 connected by conduit 82 to a source of combustion air 84 and a second combustion air control valve 86 downstream of the first combustion air blocking valve for introduction of a controlled amount of combustion air within the combustor 22 or 24 in the immediate vicinity of the end of the pilot burner assembly 54. The selective introduction of a controlled amount of combustion air in the immediate vicinity of the end of the pilot burner assembly 54 is defined as the "puff cycle". In addition to regulating the amount of combustion air introduced into the combustor 22 or 24, the second valve means precisely sequences the introduction of "puff" air in a predetermined pattern to coincide with the flow of pilot fuel and pilot air to the pilot burner assembly 54 and igniter 111, as will be explained in more detail herein.

In a preferred embodiment, the second combustion air control valve 86 is a 12 inch diameter butterfly type control valve approximately 37% open for introducing combustion air into a combustor 22 or 24 of approximately 3,000 $ft^3$ in size. However, it will be appreciated that the second combustion air control valve 86 opening may be adjusted as required to supply a controlled amount of air ("puff air") in the immediate vicinity of the end of the pilot burner assembly 54 just sufficient for ignition of the pilot burner assembly yet maintain the inert atmosphere within the combustor 22 or 24 as determined by the flow rates of the fuel, air, valve size, and combustor size.

Figure 6:
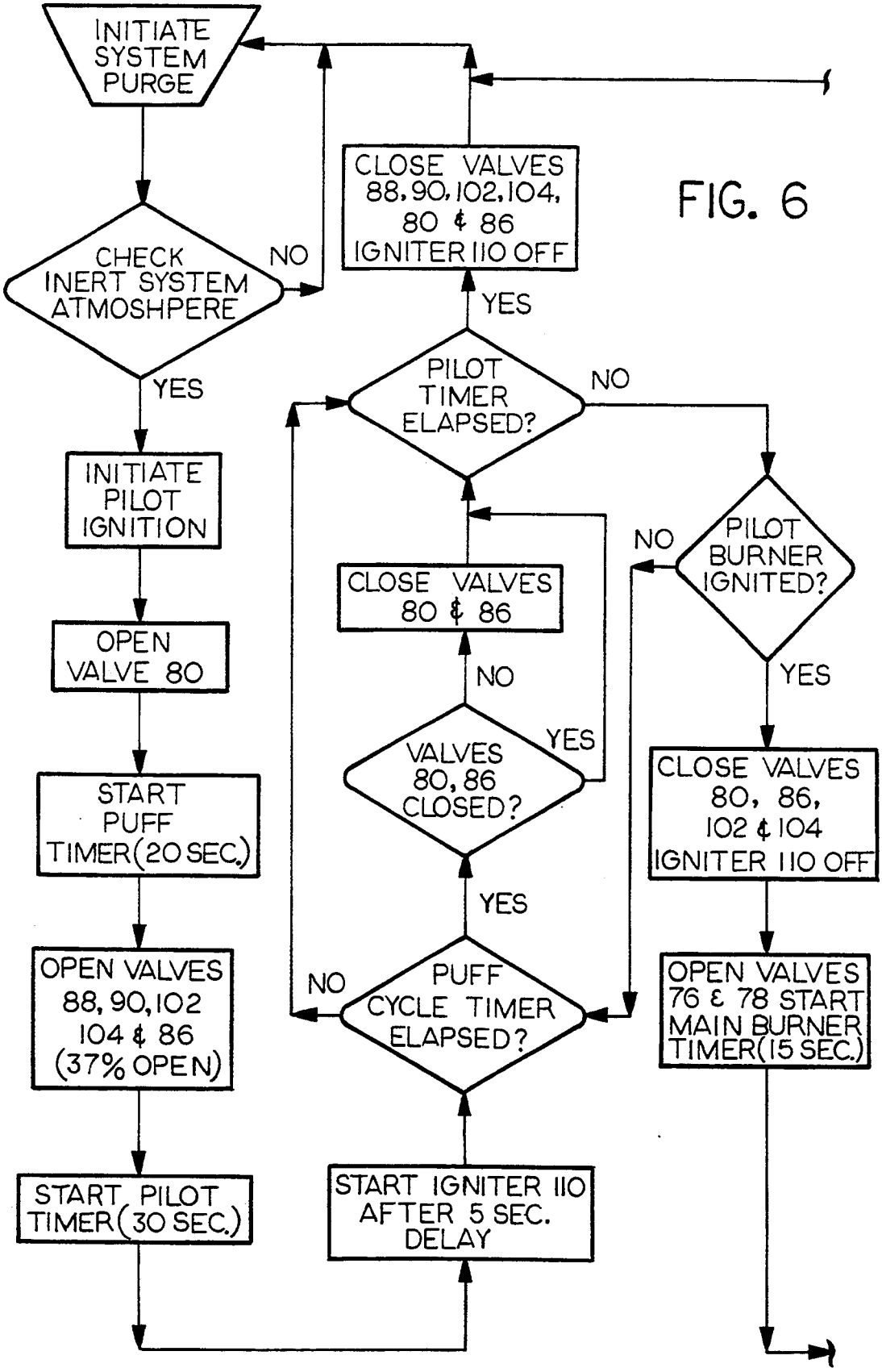
FIG. 6 is a flow chart of the pilot burner and main burner ignition sequence.
Figure 6A:
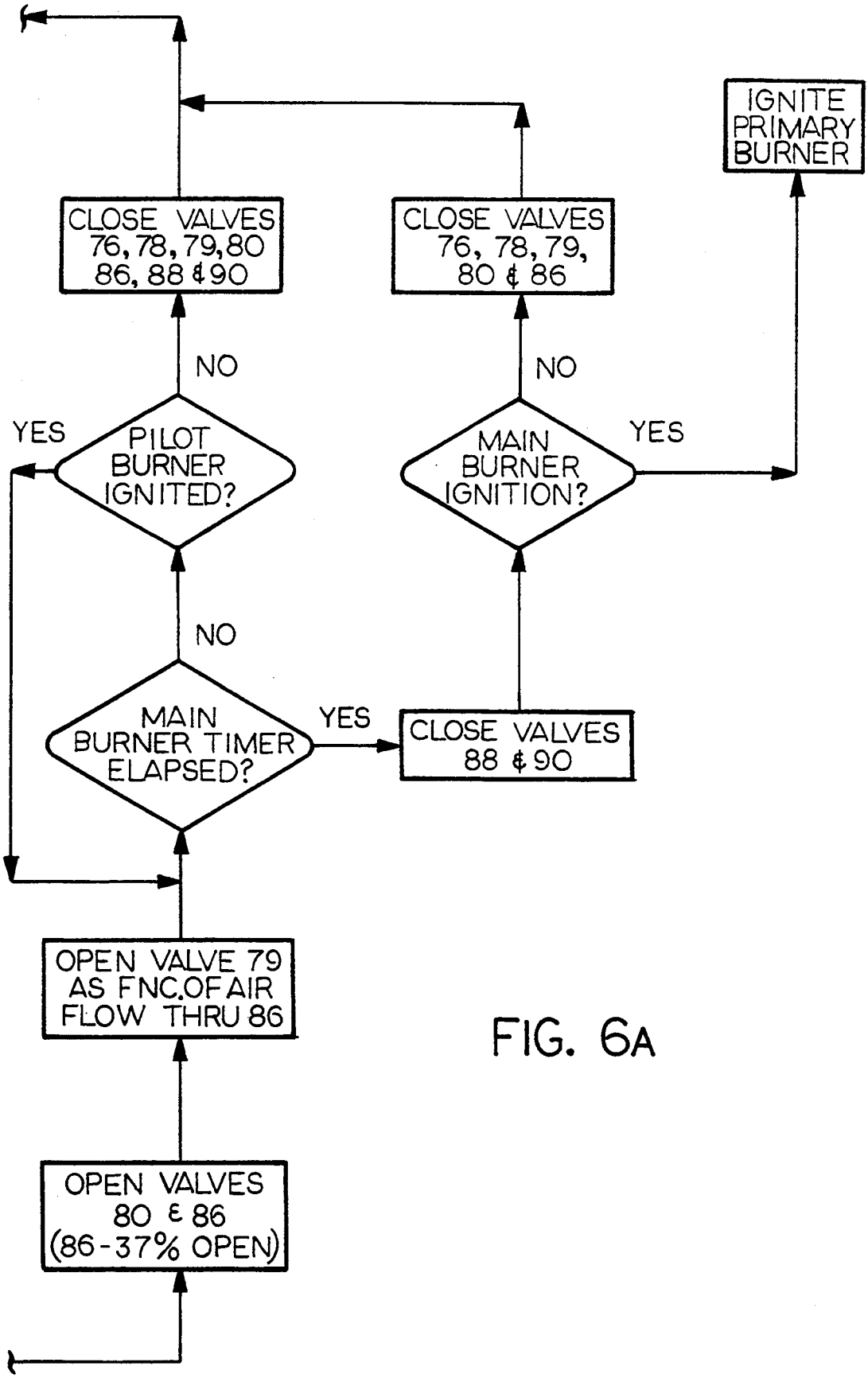

Referring to FIGS. 5 and 6, as is well known in the art, for safety reasons, during start-up of the combustor 22 or 24, nitrogen is supplied to purge the system 10 and create an inert atmosphere within the combustor. Once an inert atmosphere is established throughout the system 10, the pilot burner assembly 54 of each of the combustors is ignited (FIGS. 3–6).

Ignition of the pilot burner assembly 54 is initiated by introduction of the "puff cycle". The first combustion air blocking valve 80 is energized to the open position to allow air to flow to the second combustion air control valve 86. Once the first combustion air blocking valve 80 is open the second combustion air control valve 86 is energized in a partially open position. In a preferred embodiment, the second combustion air control valve 86 is energized to an approximately 37% open position. The first combustion air blocking valve 80 and second combustion air control valve 86 permit the controlled introduction of "puff" air into the combustor 22 or 24 for a predetermined period of time or until ignition of the pilot burner assembly 54 is established, whichever is the first to occur.

As the "puff" air is introduced to the combustor 22 or 24, air and fuel from the pilot fuel source 94 and pilot air source 92 are simultaneously introduced to the pilot burner assembly 54 and a pilot timer interval sequence is initiated. As shown in FIG. 5, air and fuel from the pilot air source 92 and pilot fuel source 94 are simultaneously selectively introduced at ignitable proportions through a third valve means having a first pilot air blocking valve 88 and a second pilot fuel blocking valve 90 connected by conduit 96 to a mixing tee 98 for introduction of a mixture of pilot fuel and pilot air to pilot tube 100 of the pilot burner assembly 54. Similarly, air and fuel from the pilot air source 92 and pilot fuel source 94 are simultaneously selectively introduced at ignitable proportions through a fourth valve means including flame air generator blocking valve 102 and flame fuel generator blocking valve 104 and conduit 106 to a mixing tee 108. From the mixing tee 108 the mixture of air and fuel flows to a flame generator 110 where the mixture is ignited or energized at predetermined intervals to produce a secondary flame within the combustor 22 or 24 adjacent the end of the pilot tube 100.

As shown in FIG. 5, the flame generator 110 includes an igniter 111 positioned external of the combustor 22 or 24 for ease of access and to isolate the igniter from the high temperature formed within the combustor and a firing tube 114 internal of the combustor. The igniter 110 may be, for example, of an electric spark type, hot surface type, flame type or shock wave type. The igniter 110 raises the mixture of fuel and air to the ignition temperature to produce a secondary flame 112. In a preferred embodiment, an electric spark igniter 110 of a type known in the art provides 12,000 volts to ignite the mixture of pilot fuel, pilot air and combustion air approximately 5 seconds after opening of the pilot fuel blocking valve 90, air blocking valves 88, 80 and air control valve 86 for about a 0.1 second pulse and at 5 second intervals thereafter for a total elapsed time of 25 seconds. Once the secondary flame 112 ignites the mixture of pilot fuel, pilot air and combustion air as determined by the flame sensors, the flame generator air blocking valve 102, flame generator fuel blocking valve 104 and fourth valve means are closed and the igniter 111 is de-energized. However, if after 25 seconds the pilot flame is not ignited by the secondary flame, the flame generator air valve 102 and flame generator fuel valve 104 and the first pilot air valve 88 and second pilot fuel valve 104 are de-energized and closed. The process of igniting the pilot flame may be reinitiated manually after inspection of the combustors 22 and 24.

As shown in FIG. 5, the firing tube 114 in communication with the igniter 111 extends within the combustor 22 or 24 parallel to the pilot tube 100 for introduction of the secondary flame 112 adjacent the end of the pilot tube. To improve the draft of the secondary flame 112 a cowl 116 is provided on the tip of the firing tube 114. The cowl 116 directs the secondary flame 112 toward the end of the pilot tube 100, thereby concentrating the effects of the secondary flame on the mixture exiting from the pilot tube.

Upon ignition of the mixture exiting from the pilot tube 100 to form the pilot flame, the first main air blocking valve 80, second main air control valve 86, flame generator air blocking valve 102, flame generator fuel blocking valve 104 are de-energized and closed and the ignitor 111 is de-energized. The pilot burner assembly 54 produces a pilot flame for ignition of a combustible mixture of combustion air and main fuel of a main burner assembly 56 to initially produce the high sensible heat for use in the system 10.

The main burner assembly 56 includes a burner tube 70 projecting within the combustor 22 or 24 to approximately the forward end of the inner chamber 52 for introduction of main fuel into the combustor. The main fuel passes from a main fuel source 72 through a first valve means including a conduit 74, first main fuel blocking valve 76, second main fuel blocking valve 78, and third main fuel control valve 79 and main burner tube 70 to inner chamber 52 of the combustor 22 or 24. After the first main air blocking valve 80, second main air control valve 86, flame generator air blocking valve 102, flame generator fuel blocking valve 104 are de-energized and closed and the ignitor 111 is de-energized the first main fuel blocking valve 76 and second main fuel blocking valve 78 are opened. Next, the first main air blocking valve 80 and second main air control valve 86 are opened (second main air control valve 86 opened 37%) and then the third main fuel control valve 79 is opened proportionally with the rate of combustion air flow through conduit 82. The fuel introduced from the main fuel source 72 through the first valve means and combustion air from the second valve means form a combustible mixture for ignition of the main burner 56 within the combustor 22 or 24. The combustion of the mixture of combustion air and main fuel of the main burner 56 initially produces the high sensible heat for use in the system 10. The first pilot air blocking valve 88 and the second pilot fuel blocking valve 90 remain open for a period of approximately 15 seconds as determined from the period of time that the first main fuel blocking valve 76 and second main fuel blocking valve 78 are opened. After the 15 second period the flame sensors 58 scan to determine if the mixture of main fuel and combustion air within the main burner tube 70 is ignited. If the main burner assembly 56 is not ignited then the first main fuel blocking valve 76, second main fuel blocking valve 78, third main fuel control valve 79, first combustion air blocking valve 80 and second combustion air control valve 86 are closed and the burner ignition sequence is reinitiated. During the above described 15 second period, the flame sensors 58 also continue to scan for a flame within the pilot burner assembly 54. If at any time no flame is detected within the combustor 22 or 24, the first main fuel blocking valve 76, second main fuel blocking valve 78, third main fuel control valve 79, first combustion air blocking valve 80, second combustion air control valve 86, first pilot air blocking valve 88 and the second pilot fuel blocking valve 90 are closed and the ignition sequence must be repeated.

The pilot burner system in accordance with the present invention must mix the fuel (e.g., methane), and oxidizing agent (e.g., combustion air), in proportions that are within the limits of flammability for ignition and steady combustion without substantially changing the inert nature of the gas atmosphere within the system 10. Furthermore, the fuel and combustion air must be supplied at rates that allow complete combustion without any burning back into the fuel supply system or carrying of the flame into a low temperature region where the flame may be quenched. Ignition of the fuel and combustion air mixture is a function of temperature, pressure and the like as is well known in the art.

The valves of the burner assemblies 54 and 56 are controlled by solenoids, in response to a control signal from a programmable logic controller of conventional design such as an Allen Bradley programmable logic controller, not shown, as determined by the operation of the valve sequence previously described and burner ignition condition as determined by the flame sensors 58.

The pilot burner assembly 54 in accordance with the present invention prevents the contamination of the inert atmosphere within the system 10 by intermittently providing controlled bursts or "puffs" of air above that required for the theoretical combustion of the pilot fuel to enable the pilot burner to ignite. The pilot burners produce products of combustion, low in oxygen, from any one of the combustors 22 or 24 from the very onset of the combustor ignition thereby avoiding the condition of excess unburned fuel or excess oxygen flowing from the combustors during periods of ignition.

For example, a pilot burner assembly 54 in accordance with the present invention provides products of combustion within the combustor containing no more than approximately 0.5% oxygen as measured at the exit of the combustor for the pyrolyzer circuit and no more than approximately 1.0% oxygen as measured at the exit of the combustor for the dryer circuit.

During operation, combustion of the main fuel and combustion air and, as required recycled inert gas, proceeds within the combustion chamber of the combustors 22 and 24 at a temperature between approximately 1550–2050 degrees fahrenheit, and preferably 1600–1950 degrees fahrenheit at near stoichiometric conditions, thereby producing high sensible heat products of combustion containing carbon dioxide, carbon monoxide, water vapor, nitrous oxides and sulphur oxides. It will be appreciated that a combustion temperature above 1550 degrees fahrenheit oxidizes potential air pollutants and below 1959 degrees fahrenheit avoids the formation of excessive amounts of nitrogen oxides.

Further enhancement of the combustion process may be achieved by mixing recycled inert gas exiting from the pyrolyzer 16 with the fuel and air entering the first combustor 22. It will be appreciated that by recycling low sensible heat inert gas and mixing the gas with the fuel and air, hydrocarbon vapors, carbon monoxide and hydrogen sulfide are removed from the inert gas and fuel value is obtained from the recycled inert gas. In addition, because inert gas is recycled, large volumes of economical high sensible heat inert gas may be produced for both drying and pyrolysis than would otherwise be possible.

Recycled inert gas exiting from the pyrolyzer 16 is then mixed with the main fuel and combustion air and acts to attemperate the combustion process to achieve the desired outlet temperature, products of combustion chemistry and mass flow rate for subsequent introduction into a mixing tee 30 for mixing with additional low sensible heat inert gas which bypasses the first combustor 22. The controlled products of combustion from the first combustor 22 are then conveyed to the mixing tee 30 and mixed with low sensible heat recycled inert gas from the pyrolyzer 16 to form high sensible heat inert gas having a desired on-gas temperature. The first combustor 22 is continually monitored for the purpose of increasing or decreasing the amount of recycled inert gas to be mixed with the products of combustion. More particularly, the mass flow and the temperature of recycled inert gas, fuel and air streams entering and the products of combustion exiting the first combustor 22 are monitored to maintain minimum and maximum combustor temperature requirements as previously described. The resulting products of combustion exiting the first combustor 22, high in sensible heat and low in combustible and/or oxygen are subsequently utilized for thermal processing of reactive coal particles within the pyrolyzer 16.

In the pyrolyzer 16, sensible heat is transferred from the high sensible heat inert gas to the coal material thereby separating from the coal material volatile matter. The volatile matter is the portion of the coal material which when heated in the absence of air is liberated as gases and vapors. It will be appreciated that volatile matter does not exist by itself in coal, except for a small amount of methane, but results from thermal decomposition of the coal material. For pyrolysis of the coal, the ratio inert gas to coal is 1.5–2.5 by mass and preferably 2.0 by mass.

From the pyrolyzer 16 the admixed low sensible heat inert gas, volatile matter and solid particles are separated in a separator collection device 32 of a type well known in the art. The solid particles and volatile matter may then be transferred for storage and the low sensible heat inert gas recycled to either the first combustor for renewal and/or the drying process 12 and/or mixing with the products of combustion from the first combustor.

The drying process 12 includes a second combustor 24, a dryer 18 and, if desired, a scrubber 34. The second combustor 24 is substantially similar to the first combustor 22 in design and operation as described above to produce high sensible heat inert gas for drying the coal material within the dryer. The products of combustion from the second combustor 24 are conveyed to the dryer 18 to remove moisture from the coal, thereby producing a dry high heating value coal material. For drying of the coal, the ratio of inert gas to coal is 3.0–6.0 by mass, and preferably 3.5 by mass.

It will be appreciated that the first and second combustors 22 and 24 also act as internal flares for environmental emission control following an unplanned shutdown with hydrocarbon vapors present in the dryer 18 or pyrolyzer 16. The thermal inertia or stored energy in the combustor refractories will serve as an auto-ignition source for the hydrocarbon vapors remaining in the system. Auxiliary fuel and combustion air may also be provided on a contingency basis to thermally oxidize otherwise undesirable vapors within the inert gas prior to their release from the system 10.

From the dryer 18 the vapor is treated to separate solid particles from the low sensible heat vapor product exiting from the dryer within a separator 36 device of a type well known in the art. The low sensible heat vapor exiting from the separator 36 may then be either vented or recycled and mixed with the products of combustion exiting from the second combustor 24.

The second combustor 24 is continually monitored for the purpose of increasing or decreasing the inert gas content of the products of combustion from the second combustor. More particularly, the mass flow and the temperature of inert gas and air streams entering and products of combustion exiting the second combustor are monitored to maintain minimum and maximum combustor temperature requirements as previously described.

It is to be understood that although the present invention has been described with reference to the ignition of a pilot burner for the heat treatment of combustible materials such as a solid carbonaceous material (e.g., coal), it will be appreciated by those skilled in the art that the present invention may find application as a means for igniting a flame in most any inert atmosphere to maintain the inert nature of the atmosphere.

The publications, documents, patents and patent applications referred to herein are hereby incorporated by reference.

Having described presently preferred embodiments of the invention, it is to be understood that it may be otherwise embodied within the scope of the appended claims.

What is claimed is:

1. A process for igniting a main burner of a combustor to produce a main burner flame within a closed system containing an inert atmosphere without substantially contaminating the inert atmosphere, the process comprising the steps of:

a) purging the combustor to establish an inert atmosphere within the combustor;

b) supplying a controlled amount of combustion air for a predetermined interval of time to said combustor;

c) substantially simultaneously supplying a controlled mixture of fuel and air to a pilot burner and to a flame generator;

d) intermittently igniting the controlled mixture of fuel and air to the flame generator to produce a secondary flame;

e) igniting the controlled mixture of fuel and air to the pilot burner and the combustion air with the secondary flame to produce a pilot burner flame;

f) supplying a controlled amount of fuel and air to the main burner within the combustor; and g) igniting the controlled amount of fuel and air to the main burner with the pilot burner flame to produce a main burner flame.

2. The process of claim 1 further comprising the step of terminating the supply of fuel and air to the flame generator after ignition of the pilot burner.

3. The process of claim 2 further comprising the step of terminating the supply of fuel and air to the pilot burner after ignition of the main burner.

4. The process of claim 3 wherein the controlled mixture of fuel and air to the flame generator is supplied periodically for a selected period of time after supplying a controlled mixture of fuel and air to a pilot burner until ignition of the pilot flame or lapse of the selected period of time.

5. The process of claim 4 wherein the flame generator is activated approximately 5 seconds after supplying a controlled mixture of fuel and air to a pilot burner and at 5 second intervals thereafter.

6. The process of claim 5 wherein the selected period of time is approximately 25 seconds.

7. The process of claim 1 wherein the controlled amount of combustion air is supplied for a predetermined interval of time to said combustor in the immediate vicinity of the pilot burner.

8. A process for igniting a pilot burner assembly of a combustor to produce a pilot burner flame within a closed system containing an inert atmosphere without substantially contaminating the inert atmosphere, the process comprising the steps of:

a) purging the combustor to establish an inert atmosphere within the combustor;

b) supplying a controlled amount of combustion air for a predetermined interval of time to said combustor;

c) substantially simultaneously supplying a controlled mixture of fuel and air to the pilot burner and to a flame generator;

d) periodically igniting the controlled mixture of fuel and air to the flame generator to produce a secondary flame; and e) igniting the controlled mixture of fuel and air to the pilot burner and the combustion with the secondary flame to produce a pilot burner flame.

9. The process of claim 8 further comprising the step of terminating the supply of fuel and air to the flame generator after ignition of the pilot burner.

10. The process of claim 9 wherein the controlled mixture of fuel and air to the flame generator is activated periodically for a selected period of time after supplying a controlled mixture of fuel and air to a pilot burner until ignition of the pilot flame or lapse of the selected period of time.

11. The process of claim 10 wherein the flame generator is activated approximately 5 seconds after supplying a controlled mixture of fuel and air to a pilot burner and at 5 second intervals thereafter.

12. The process of claim 11 wherein the selected period of time is approximately 25 seconds.

13. The process of claim 8 wherein no more than approximately 1.0% oxygen is present at the combustor exit.

14. A process for igniting a primary burner of a combustor to produce a primary burner flame within a closed system containing an inert atmosphere without substantially contaminating the inert atmosphere, the process comprising the steps of:

a) purging the combustor to establish an inert atmosphere within the combustor;

b) supplying a controlled amount of combustion air for a predetermined interval of time to said combustor;

c) substantially simultaneously supplying a controlled mixture of fuel and air to a pilot burner and to a flame generator;

d) periodically igniting the controlled mixture of fuel and air to the flame generator to produce a secondary flame;

e) igniting the controlled mixture of fuel and air to the pilot burner and the combustion air with the secondary flame to produce a pilot burner flame;

f) supplying a controlled amount of fuel and air to the main burner within the combustor;

g) igniting the controlled amount of fuel and air to the main burner with the pilot burner flame to produce a main burner flame;

h) supplying a controlled amount of fuel and air to the primary burner within the combustor;

i) igniting the controlled amount of fuel and air to the primary burner with the main burner flame to produce a primary burner flame.

15. The process of claim 14 further comprising the step of terminating the supply of fuel and air to the flame generator after ignition of the pilot burner.

16. The process of claim 15 further comprising the step of terminating the supply of fuel and air to the pilot burner after ignition of the main burner.

17. The process of claim 16 wherein the controlled mixture of fuel and air to the flame generator is activated periodically for a selected period of time after supplying a controlled mixture of fuel and air to a pilot burner until ignition of the pilot flame or lapse of the selected period of time.

18. The process of claim 17 wherein the flame generator is energized approximately 5 seconds after supplying a controlled mixture of fuel and air to a pilot burner and at 5 second intervals thereafter.

19. The process of claim 18 wherein the selected period of time is approximately 25 seconds.

20. The process of claim 19 wherein the controlled amount of combustion air is supplied for a predetermined interval of time to said combustor in the immediate vicinity of the pilot burner.

21. An apparatus for igniting a pilot burner flame of a pilot burner assembly of a combustor within a closed system containing an inert atmosphere, the apparatus comprising:

a) a second valve means for selectively introducing a controlled amount of combustion air for a first predetermined period of time to said combustor;

b) a third valve means for selectively introducing fuel and air for a second predetermined period of time to a pilot burner including a pilot tube extending within said combustor;

c) a fourth valve means for selectively introducing fuel and air to a flame generator substantially simultaneously with the introduction of fuel and air to said pilot burner, said flame generator having an igniter positioned external of said combustor and a firing tube extending within said combustor parallel to said pilot burner, said igniter including means for intermittently igniting said fuel and air to produce a secondary flame within said firing tube internal of said combustor thereby igniting said controlled mixture of fuel, air and combustion air within said combustor to produce a pilot flame internal of said combustor; and d) a means for controlling the operation of said second valve means, said third valve means and said fourth valve means to provide a combustible mixture of fuel, air and combustion air within said combustor in the vicinity of said igniter and said pilot tube.

22. The apparatus of claim 21 including means wherein said flame generator ignites said controlled mixture of fuel and air periodically for a selected period of time until ignition of said pilot flame or lapse of said selected period of time.

23. The apparatus of claim 22 including means wherein said flame generator is activated approximately 5 seconds after a supply of controlled mixture of fuel and air is supplied to a pilot burner and at 5 second intervals thereafter.

24. The apparatus of claim 23 wherein said selected period of time is approximately 25 seconds.

25. The apparatus of claim 21 including means for supplying said controlled amount of combustion air for a predetermined interval of time to said combustor in the immediate vicinity of said pilot burner.

26. The apparatus of claim 25 wherein said firing tube includes a cowl for directing said secondary flame toward an end of said pilot tube.

27. The apparatus of claim 21 wherein said second valve means includes a first combustion air valve and a second combustion air valve for introducing a controlled amount of combustion air within said combustor in the immediate vicinity of said pilot burner assembly.

28. The apparatus of claim 27 further comprising a first valve means for supplying a controlled amount of fuel and air to a main burner within said combustor, whereby said controlled amount of fuel and air to said main burner is ignited by said pilot burner flame to produce a main burner flame.

* * * * *